US005370966A

United States Patent [19]

Bagchi et al.

[11] Patent Number: 5,370,966

[45] Date of Patent: Dec. 6, 1994

[54] SURFACTANT DYE-DIFFUSION-TRANSFER FACILITATING THERMAL SOLVENTS FOR IMAGE SEPARATION SYSTEMS

[75] Inventors: Pranab Bagchi, Webster; David S. Bailey, Rochester, both of N.Y.

[73] Assignee: Eastman Kodak Company, Rochester, N.Y.

[21] Appl. No.: 159,022

[22] Filed: Nov. 29, 1993

[51] Int. Cl.[5] ..... G03C 5/54

[52] U.S. Cl. ..... 430/203; 430/218; 430/559; 430/617; 430/637; 430/639; 430/546

[58] Field of Search ..... 430/203, 218, 617, 637, 430/639, 546, 559

[56] References Cited

U.S. PATENT DOCUMENTS

| | | | |
|---|---|---|---|
| 2,240,469 | 4/1942 | Swan et al. | 430/637 |
| 3,767,410 | 10/1973 | Brust | 430/639 |
| 4,762,776 | 8/1988 | Uesawa et al. | 430/538 |
| 4,868,097 | 9/1989 | Autsuka et al. | 430/203 |
| 4,895,791 | 1/1990 | Mukunoki | 430/637 |
| 4,952,479 | 8/1990 | Aono et al. | 430/203 |
| 4,983,502 | 1/1991 | Ohbayashi et al. | 430/203 |
| 5,013,640 | 5/1991 | Bagchi et al. | 430/637 |
| 5,051,349 | 9/1991 | Taguchi et al. | 430/203 |
| 5,135,844 | 8/1992 | Bagchi et al. | 430/637 |
| 5,270,145 | 12/1993 | Willis et al. | 430/203 |

FOREIGN PATENT DOCUMENTS

| | | |
|---|---|---|
| 0545434 A1 | 6/1993 | European Pat. Off. . |
| 2243259 | 3/1974 | Germany . |
| 592676 | 9/1947 | United Kingdom . |

*Primary Examiner*—Richard L. Schilling
*Attorney, Agent, or Firm*—Paul A. Leipold

[57] ABSTRACT

The invention discloses an aqueous-developable chromogenic photographic heat-transferable non-aqueous dye-diffusion-transfer photographic element comprising radiation sensitive silver halide, a dye-providing compound that forms or releases a heat-transferable, image dye upon reaction of said compound with the oxidation product of a primary amine developing agent, a hydrophilic binder, and a thermal solvent for facilitating non-aqueous diffusion transfer wherein said thermal solvent comprises a sugar group containing amphiphilic compound, said amphiphilic compound comprising from one to three independently constituted 3 to 22 carbon atom hydrophobic tail(s) with one or more attached hydrophilic mono or oligosaccaridic rings or chains such that the HLB value of the compound is less than about 13.

29 Claims, 1 Drawing Sheet

SURFACTANT DYE-DIFFUSION-TRANSFER FACILITATING THERMAL SOLVENTS FOR IMAGE SEPARATION SYSTEMS

FIELD OF THE INVENTION

This invention relates to chromogenic photographic imaging systems that utilize silver halide based radiation sensitive layers and associated formation of image dyes. In particular, this invention relates to such systems where the resulting dye images, when the photographic elements are substantially dry, are transferred to a polymeric receiver layer, thereby separating the developed silver and dye images.

BACKGROUND OF THE INVENTION

Color photographic materials are known that are either aqueous developable or heat developable. In heat developable color photographic materials it is often desirable to separate the resultant dye image from the developed silver and silver halide by transferring the color image dye to a reciever layer. Images of improved color saturation and greater long term color stability can be obtained in this manner. In aqueous developable color photographic systems the developed silver and silver halide is removed by bleaching and fixing to obtain images substantially free of silver in order to obtain improved color saturation and long term color stability. Bleaching and fixing processes result in the generation of solutions that contain silver ions and other chemicals that adversely impact the environment.

To improve the performance of the elements and processes described above a color photographic element containing certain surfactants is described that allows facile separation of the color image dye from the image generations layer(s) to a reciever layer.

Polyhydric alcohol compounds in Aqueous-developable Non-diffusion-transfer Color Photographic Systems. Polyhydric alcohol compounds have been employed in photographic elements to obtain a variety of improvements. Swan and Lindquist (U.S. Pat. No. 2,240,469, issued Apr. 29, 1941) describe the use of alkylene glycol ethers of polyhydric alcohol surface active agents (surfactants) as synthetic spreading agents of improve air bubble prevention in the coating of photographic materials. British Patent No. 592,676, issued Sep. 25, 1947 to E. I. DuPont DE Nemours and Co., describes a monochromatic silver halide element containing polyalkene ethers of hexitols as offering improvements in the induction period for development and increase loading of the wetting agent saponin. Brust and Kane (U.S. Pat. No. 3,767,410, issued Oct. 23, 1973) describe the combination of certain polysaccharides with silver halide emulsions as viscosity thickeners. Uesawa and Moimoto (U.S. Pat. No. 4,762,776, issued Aug. 9, 1988) describes a combination of a polyhydric alcohol and an alkyl acrylate polymer latex in a gelatin binder/silver halide emulsion layer to reduce remaining curl in roll-fed photographic paper. Bagchi et al in U.S. Pat. No. 5,013,640 disclose the use of various amphiphilic surfactants as viscosity control agents in small particle dispersions in integral color photographic elements.

Polyhydric alcohol compounds in Thermally-developable Diffusion-transfer Color Photographic Systems. Taguchi and Hirai in U.S. Pat. No. 5,051,349, issued Sep. 24, 1991, describe a heat-developable color-image transfer element containing mono- or oligosaccharides for improved $D_{min}$ stability. The transferrable dye contains a low pKa functional group that is substantially ionized under the conditions of dye diffusion.

Thermal Solvents in heat-transferable non-aqueous dye-diffusion transfer color photographic elements. Texter and Willis in E.P. 0545434 and U.S. Ser. No. 07/804,877 filed Dec. 6, 1991 have described a novel heat-transferable non-aqueous dye-diffusion transfer color photographic image separation element. Bailey et al in U.S. Ser. No. 07/804,868 filed Dec. 6, 1991 have disclosed the use of certain phenolic materials as thermal solvents for the above heat transferable non-aqueous dye-diffusion transfer image separation element. Bailey et al in U.S. Ser. No. 08/073,821 filed Jun. 8, 1993, Bailey et al in U.S. Ser. No. 08/073,822 filed Jun. 8, 1993, Bailey et al in U.S. Ser. No. 08/073,825 filed Jun. 8, 1993, and Bailey et al in U.S. Ser. No. 08/073,826 filed Jun. 8, 1993 have disclosed certain hydrogen bond donating/hydrogen bond accepting materials as thermal solvents for the heat transferable non-aqueous dye-diffusion transfer image separation element described in Texter and Willis above.

PROBLEMS TO BE SOLVED BY THE INVENTION

A major problem that remains in aqueous developed dry thermal transfer systems, wherein the dye images so formed are transferred by diffusion through substantially dry gelatin, is to facilitate the ease with which such dye images may be transferred from the image generating layer to the receiver layer. Further, heat-transferable dye-diffusion facilitating thermal solvents of the prior art are considered expensive and more economical materials would be desireable. Similar problems with respect to dry dye diffusion transfer exist in color photothermographic systems that rely on dry or heat development processes.

Much of the color-image diffusion transfer art utilizes wet gelatin and low pKa dye release chemistry that is much more expensive than the simple silver halide based indoaniline dye forming chemistry obtained, for example, in conventional aqueous development of silver halide systems. More economical materials would be desireable.

These and other problems may be overcome by the practice of our invention.

SUMMARY OF THE INVENTION

An object of the present invention is to overcome the disadvantages of the prior processes and products. A further object of the present invention is to provide improved image dye diffusion transfer efficiency.

A further object of the present invention is to allow improved separation of the silver, silver halide, and unused chromogenic chemistry from the dye image. Another object of the present invention is to provide a chromogenic imaging system wherein much of the chemistry utilized in creating the image is recoverable and recyclable. Yet another object of the present invention is to provide an imaging system which minimizes toxic effluent and environmental contamination. A significant further object of the present invention is to provide an improved process of image formation comprising eliminating bleaching, fixing and bleach-fixing processing steps. A still further object of the present invention is to provide inexpensive dye-diffusion facilitating agents in dry-diffusion transfer photographic systems.

These and other objects of the invention are generally accomplished by providing a chromogenic photographic heat-transferable non-aqueous dye-diffusion-transfer photographic element comprising radiation sensitive silver halide, a dye-providing compound that forms or releases an image dye upon reaction of said compound with the oxidation product of a primary amine developing agent, a hydrophilic binder, and a dye transfer facilitating thermal solvent for facilitating non-aqueous diffusion transfer wherein said thermal solvent is a mixture of the following inexpensive amphiphilic molecules of the following type:

A sugar group containing amphiphilic compound comprising between one to three independently constituted 3 to 22 carbon atom hydrophobic tail(s) with one or more attached hydrophilic mono or oligosaccharidic rings or chains.

ADVANTAGEOUS EFFECT OF THE INVENTION

We have discovered that selected examples of amphiphilic molecules serve to advantageously improve the diffusion of image dyes through relatively dry photographic binders such as gelatin to a receiver element. Compositions of the present invention yield dramatically improved dye images in receiver layers of the photographic element over that obtained through gelatin layers. Amphiphilic compounds suitable for the invention are relatively low in cost. Thus, lower cost heat-transferable dye-diffusion transfer elements can be constructed using lower amounts of incorporated imaging chemistry and less expensive dye transfer facilitating thermal solvent. The compositions of the present invention eliminate the bleaching and fixing treatments in aqueous developable photographic elements, thus removing a potential source of environmental degradation. Less expensive imaging chemistry can be employed in heat developable color image transfer elements. The materials in the color photographic element are readily available for recycling.

DETAILED DESCRIPTION OF THE INVENTION

Figure 1:
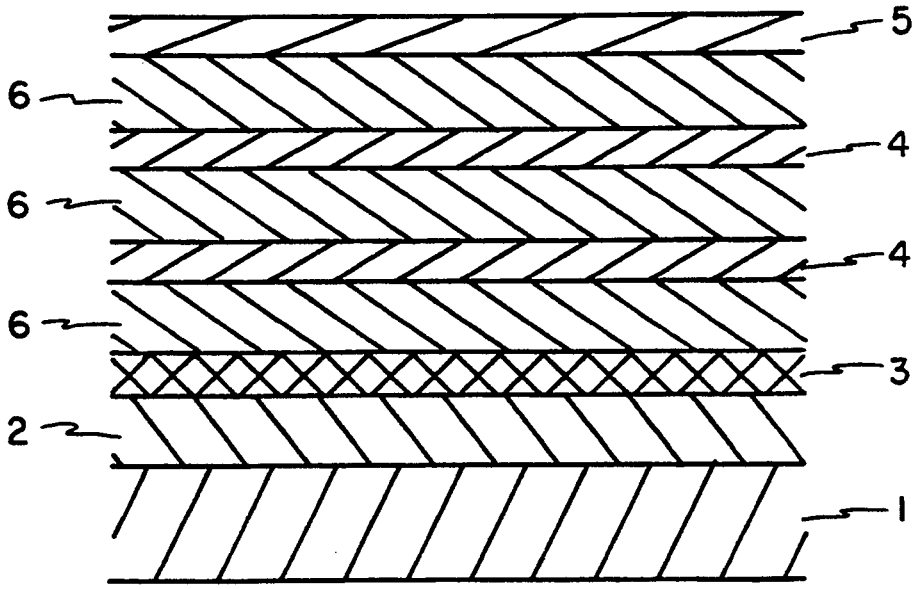
FIG. 1. Photographic element layer-structure for heat image separation system: 1—transparent or reflection base; 2—polymeric receiving layer;, 3—stripping layer (optional); 4—interlayers; 5—protective overcoat layer; 6—diffusion transfer dye generation layers. The number of dye generation layers (6) is greater than or equal to one. Interlayers (4) between dye generation layers (6) are optional.

A novel method of imaging, whereby conventional aqueous development processes are utilized in combination with substantially dry thermally activated diffusion transfer of image dyes to a polymeric receiver has been described by Willis and Texter in commonly assigned E.P. 0545434 and U.S. application Ser. No. 07/804,877 filed Dec. 6, 1991 and hereby incorporated by reference. The methods and processes disclosed therein are incorporated herein by reference. The essential morphology of such an imaging system is illustrated in FIG. 1. It essentially consists of a conventional multilayer photographic element coated on a polymeric receiver element. The conventional element comprises one or more dye generation layers (6) and optionally one or more interlayers (4) and a protective overcoat (5) layer. This multilayer structure is coated on a receiver layer (2) with an optional intervening stripping layer (3). The receiver layer (2) is coated on an appropriate transparent or reflection base (1). Images are created by conventional radiation sensitivities in the silver halide emulsion containing layers, and these images are amplified using conventional aqueous color development processes. After the development, the development is stopped with an appropriate wash or stop bath, and thereafter the element is dried. Preferred stop baths have an acidic pH. No fixing or bleaching chemistry need be invoked in this process, and bleaching, fixing, and bleach-fixing processing steps are omitted in preferred embodiments of the present invention process. After the elements have been dried, they are subjected to heating, in order to drive the heat-transferable image dyes to the receiver layer. After such image transfer, the donor layers are removed and are available for recycling in order to recover silver and valuable fine organic compounds, while the receiver/base combination is retained as the final print material.

We define the term "heat transferable" used herein as applied to image dyes to mean that said dyes will diffuse through hydrophilic binder when heated to temperatures in excess of 50° C. and when this hydrophilic binder is substantially dry with respect to the absorbed water, where the amount of absorbed water in this binder is less than 50% by weight relative to the binder and furthermore wherein said dyes are substantially insoluble and nondiffusible in aqueous medium of pH 7 to 13.

U.S. Pat. No. 5,164,286, Texter et al., hereby incorporated by reference, discloses a preferred method of separating receiver elements from the imaging layers. The thermal solvents of this invention are particularly effective in aiding the transfer of dyes formed by reaction of couplers with oxidized developer or by other means from imaging layers to a receiver element. The receiving element, containing the transferred dye image, is then separated from the imaging layers. Said separated receiving element constitutes the final print material.

In the present invention, thermal solvents are included in a chromogenic photographic heat-transferable dye-diffusion-transfer element, substantially dry and activated by heat, and comprising contacting dye-receiver and dye-donor layers. Thermal solvent of our invention constitute amphiphilic molecules with both hydrophilic and hydrophobic moieties. Such compounds as defined in the following aid the transfer of dye molecules to the receiver layer of the photographic element of this invention.

This invention provides an aqueous-developable chromogenic photographic heat-transferable non-aqueous dye-diffusion-transfer photographic element comprising radiation sensitive silver halide, a dye-providing compound that forms or releases an image dye upon reaction of said compound with the oxidation product of a primary amine developing agent, a hydrophilic binder, and a thermal solvent for facilitating non-aqueous dye-diffusion transfer wherein said thermal solvent is a surfactant sugar group containing amphiphilic compound comprising from one to three independently constituted 3 to 22 carbon atom hydrophobic tail(s) with one or more attached hydrophilic mono or oligosaccharidic rings or chains such that the HLB value of the compounds is less than about 13.

Specific examples of suitable thermal solvent surfactants for the practice of this invention are listed in Table I as follows:

TABLE I

Examples of Surfactants of This Invention

SSTS-1

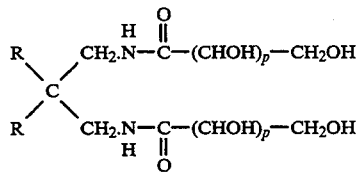

where,
R = n-$CH_3(CH_2)_n$— (where n = 2 to 12), or

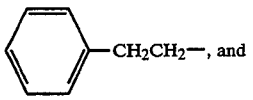

p = 3 to 10.

SSTS-2

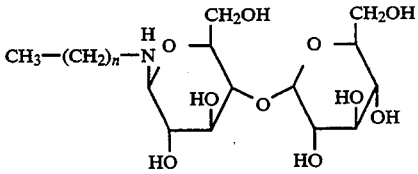

where, n = 5 to 21.

SSTS-3

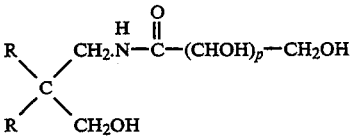

where,

R = n-$CH_3(CH_2)_n$— (where n = 2 to 12), or

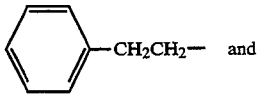

p = 3 to 10.

SSTS-4

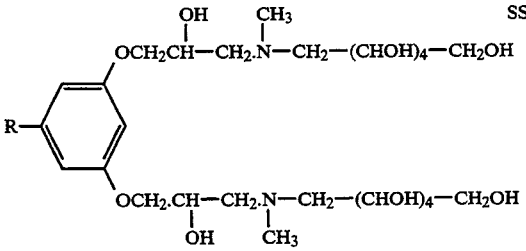

R = n-$CH_3(CH_2)_n$— (where n = 5 to 15).

SSTS-5

$CH_3(CH_2)_nOCH_2CH(OH)CH_2NHC(=O)(CHOH)_4CH_2OH$ where, n = 5 to 21.

TABLE I-continued

Examples of Surfactants of This Invention

SSTS-6

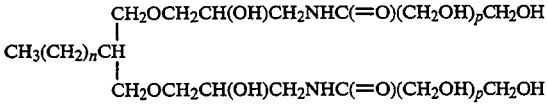

where,
n = 4 to 20
p = 3 to 10.

SSTS-7

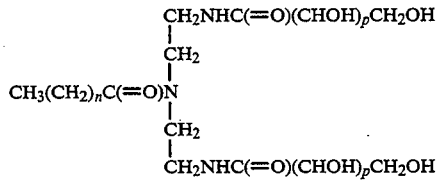

where,
n = 5 to 21
p = 3 to 10.

SSTS-8

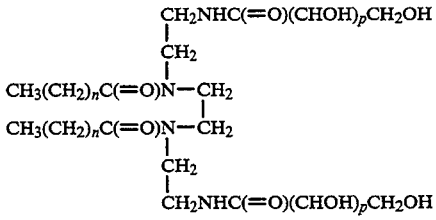

where,
n = 2 to 21
p = 3 to 10.

SSTS-9

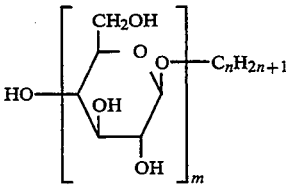

where,
n = 6 to 22
m = 1 to 4.

SSTS-10

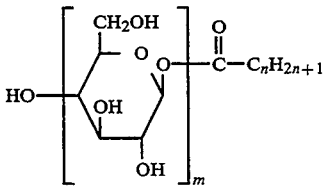

where,
n = 6 to 22
m = 1 to 4.

SSTS-11

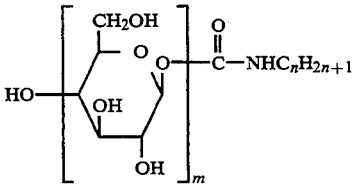

where,
n = 6 to 22

TABLE I-continued

| Examples of Surfactants of This Invention |
|---|
| m = 1 to 4. |

The most preferred amphiphilic molecules for this invention, compound SSTS-9, where the average values for m are 1.4 and for n are 12.8. Compounds of structures SSTS-9 and SSTS-10 are usually commercially available and are usually composed of mixture of compounds with a spread in the values of m and n. Therefore, specific examples such as the most preferred compound cited above have fractional values for m and n. This commercial material of the preferred embodiment is trade named APG-600 manufactured by Henkel Corporation, Cincinnati, Ohio, U.S.A.

Of these amphiphilic molecules that are commercially available and inexpensive the ones that are particularly effective as thermal solvents are the one that have a "Hydrophilic-Lipophilic Balance" (HI,B) value of less than about 13. Hydrophilic-Lipophilic Balance is a numeric rating system for the combined hydrophilic and lipophilic characteristics of an amphiphilic molecule that contains both hydrophilic and lipophilic moieties. The assignment of numeric values based upon chemical groupings in a molecule is given by A. W. Adamson in "Physical Chemistry of Surfactants," Interscience Publishers, New York, 1967 (2nd Ed.) pages 520 to 522. Adamson also provides references to experimental methods for the determination of HLB numbers of amphiphilic molecules.

Binders that can be employed in the aqueous developable photographic element of the present invention are described in *Research Disclosure*, No. 17643, p. 26 (December, 1978) and *Research Disclosure*, No. 308199, pp. 1003–1004 (December, 1989) (hereafter *Research Disclosure*, No. 308199) and include: synthetic high-molecular weight compounds such as polyvinylbutyral, polyvinyl acetate, ethyl cellulose, cellulose acetate butyrate, polyvinyl alcohol and polyvinylpyrrolidone; synthetic or natural high-molecular weight compounds such as gelatin, gelatin derivatives (e.g., phthalated gelatin), cellulose derivatives, proteins, starches, and gum arabic. These high-molecular weight compounds may be used either singly or in combination. It is particularly preferred to employ gelatin.

The binders are generally used in mounts ranging from 0.05 to 50 g, preferably from 0.2 to 20 g, per square meter of the base support. The binders are preferably used in mounts of 0.1–10 g, more preferably 0.2–5 g, per gram of the dye-providing material.

Couplers may be either four-equivalent, losing two hydrogen atoms from the coupling site during reaction with oxidized color developer, or formally two-equivalent, having a coupling-off group that is lost from the coupler during reaction with the oxidized color developer to form a dye. The coupler fragment that bears the coupling-off group and that forms the dye with the oxidized color developer is referred to as the coupler parent. Coupling-off groups are well known in the art and include, for example, alkylthio, arylthio, aryloxy, N-linked nitrogen heterocycles and chlorine. It is generally preferred in color photographic elements that the molecular weight of the couplers be above 600 (all molecular weights herein are expressed in atomic mass units). The typical molecular weight for these couplers is between 700 and 1100.

The coupler compound contained in the aqueous developable color photographic elements of the present invention may be any coupler designed to be developable by color developer solutions, and to form a heat transferable dye upon such development. While color images may be formed with coupler compounds which form dyes of essentially any hue, couplers which form heat transferable cyan, magenta, or yellow dyes upon reaction with oxidized color developing agents are used in preferred embodiments of the invention. Suitable couplers for this invention are disclosed by Willis and Texter in E.P. 0545434 and U.S. Ser. No. 804,877, filed Dec. 6, 1991. Preferred couplers for this invention are those that have a coupling-off group. Further, it is preferred that the molecular weight of the parent portion of the coupler be in the range of 90 to 600 and more preferably in the range of 110 to 400 so that the resulting dyes have increased diffusibility. The molecular weight of the entire coupler compound can be adjusted to a selected value by variation to the coupling-off group structure. Couplers that have no readily ionizable functional groups such as sulfonic acids, carboxylic acids, very strongly acidic phenols, or very strongly acidic sulfonamides are preferred in this invention so that their interaction with dry hydrophilic binder, especially gelatin, is minimized.

Suitable heat transferable dye forming compounds of the present invention provide heat transferable dyes that are devoid of functional groups with aqueous $pK_a$ values for proton loss of less than 9. Preferred heat transferable dye forming compounds of the present invention provide heat transferable dyes that are devoid of functional groups with aqueous $pK_a$ values for proton loss of less than 6. In preferred embodiments of the elements of the present invention heat-transferable dye-diffusion transfer is not significantly facilitated at 40° C. and below by wetting with aqueous alkali.

Dye-forming compounds contained in the element of our invention may be linked to a polymer structure so that on reaction with oxidized color developer the dye is chemically released from the polymer. Dye-forming compounds that are linked to polymers through the coupling site are a preferred class of compounds in our invention. Image dye-forming compounds linked to polymers so that the dye remains chemically bound to the polymer are not preferred in this invention because the dye will not readily transfer to the dye receiver layer.

The dye-transfer-facilitating thermal solvents of this invention may be contained in the same layer as that containing the heat-transferable dye-forming compound or in layers not containing these dye-forming compounds. In elements of two or more layers the thermal solvents of our invention may be contained in any, some or all layers of the element. The dye transfer facilitating thermal solvents of our invention are preferably employed at a loading of between 10 and 300% by weight of the hydrophilic binder in each layer in the photographic element, or more preferably between 40 and 150% by weight of the hydrophilic binder in each layer. Further, the amount of dye transfer facilitating thermal solvent in the element is preferred to be between 10 and 200% by weight of the hydrophilic binder in the element, or more preferably between 10 and 120% by weight of the hydrophilic binder in the element. The thermal solvents of our invention are preferably employed at a level of between 100 to 3000 mg/m$^2$ for photographic elements having only a single color record, between 200 and 4500 mg/m$^2$ for photographic elements having only two color records and between 400 and 6000 mg/m$^2$ for photographic elements comprising three color records.

Dye-transfer-facilitating phenolic thermal solvents, for use in combination with the sugar surfactant thermal solvents of the invention, have been described by Bailey, White and Texter in U.S. Ser. No. 07/804,868.

Bailey, White and Texter in U.S. Ser. No. 08/073,821, Bailey and Mura in U.S. Ser. No. 08/073,822, Bailey and Mura in U.S. Ser. No. 08/073,825, and by Bailey, Mura and Eiff in U.S. Ser. No. 08/073,826 have described dye-transfer-facilitating thermal solvents comprising both hydrogen bond accepting and hydrogen bond donating moieties that are useful in combination with the sugar surfactant thermal solvents of the invention. These materials are described by the formula (I)

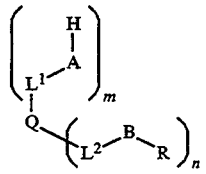

(I)

wherein

AH is a hydrogen bond donating group with a $pK_a$ for aqueous proton loss of greater than 6;

$L^1$ and $L^2$ are each independently divalent linking groups consisting of groups of 1 to 12 atoms or are independently absent;

m is 1, 2, or 3;

Q comprises a group of 2 to 15 carbon atoms selected from the group consisting of aromatic rings, alkyl chains, alkyl rings, or ring-chain combinations, optionally substituted with substituents, Z, consisting of alkyl groups or halogens;

B is a hydrogen bond accepting group with an aqueous $pK_a$ value for proton gain of less than 6;

n is 1 or 2;

the groups AH and B cannot hydrogen bond to form a ring of either 5 or 6 atoms;

R is an alkyl, aryl and alkylaryl group of from 1 to 18 carbon atoms;

the calculated log of the octanol/water partition coefficient (clogP) is greater than 3 and less than 10.

The photographic elements of our invention may contain high boiling solvents, known in the art as coupler solvents. These high boiling solvents can be employed in dispersions of the heat-transferable dye-forming compounds, interlayer scavengers, thermal solvents, or other compounds contained in the photographic element. The dye-forming compounds in the photographic elements of our invention may be employed without the use of high boiling solvents. These high boiling solvents may increase the reactivity of the heat-transferable dye-forming compound, improve the stability of the dispersion of the dye-forming compound, or may improve the transfer of heat-transferable dye from the dye generation layer to the dye receiver layer. Such high boiling solvents may be selected from any of these compounds known in the art. Coupler solvents may be contained in the dispersions of the dye-forming compounds at amounts between 0 and 400% of the dye-forming compound. High boiling solvents may be contained in dispersions of the dye transfer facilitating thermal solvents of our invention at amounts between 0 and 100% of the thermal solvent. These high boiling solvents may be dispersed with other addenda contained in the photographic element.

The primary amine developing agents useful in the practice of this invention are selected from the p-arnino-N,N-dialkylanilines known in the art of color photography. Examples of these compounds are described, for example, by R. L. Bent et al (*Photo. Sci. Eng.*, 1963, 8, 125). Primary amine developing agents that have no readily ionizable functional groups such as sulfonic acids or carboxylic acids are preferred in this invention so that the interaction between dry hydrophilic binder, especially gelatin, and the heat-transferable dye formed by the reaction with the dye-forming compound is minimized.

The aqueous developer solution may contain compounds to stabilize the developing agents against oxidation, compounds to minimized precipitation of development products, brightening agents and other compounds to maintain the stability of the developer prior to and during use. The aqueous developer solution can be employed at a wide range of temperatures but is preferred to be in the range of 15° to 55° C. The pH of the aqueous developer solution can be in the range of 8 to 12 with a preferred range of 9 to 11.

A typical multilayer, multicolor photographic element to be used with the thermal solvents of this invention comprises a support having thereon a red-sensitive silver halide emulsion layer having associated therewith a heat-transferable cyan dye image forming coupler compound, a green-sensitive silver halide emulsion layer having associated therewith a heat-transferable magenta dye image forming coupler compound and a blue-sensitive silver halide emulsion layer having associated therewith a heat-transferable yellow dye image forming coupler compound. Each silver halide emulsion layer can be composed of one or more layers and the layers can be arranged in different locations with respect to one another. Typical arrangements are described in *Research Disclosure*, No. 308199, the disclosure of which is incorporated by reference.

The light sensitive silver halide emulsions can include coarse, regular or fine grain silver halide crystals of any shape or mixtures thereof and can be comprised of such silver halides as silver chloride, silver bromide, silver bromoiodide, silver chlorobromide, silver chloroiodide, silver chlorobromoiodide and mixtures thereof. The emulsions can be negative working or direct positive emulsions. They can form latent images predominantly on the surface of the silver halide grains or predominantly on the interior of the silver halide grains. They can be chemically or spectrally sensitized. The emulsions typically will be gelatin emulsions although other hydrophilic colloids as disclosed in *Research Disclosure*, No. 308199 can be used in accordance with usual practice.

Especially useful in this invention are tabular grain silver halide emulsions. Suitable tabular grain emulsions can be selected from among a variety of conventional teachings, such as those of the following: *Research Disclosure*, No. 22534, (January, 1983); U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354.; 4,801,522; 4,806,461; 4,835,095; 4,853,322; 4,914,014; 4,962,015; 4,985,350; 5,061,069 and 5,061,616. More preferred in this invention are tabular silver chloride grains such as disclosed in U.S. Pat. Nos. 5,176,991; 5,176,992; 5,178,998; 5,183,732; 5,185,239 and EP 0534395.

The support can be of any suitable material used with photographic elements. Typically, a flexible support is employed, such as a polymeric film or paper support. Such supports include cellulose nitrate, cellulose acetate, polyvinyl acetal, poly(ethylene terephthalate), polycarbonate, white polyester (polyester with white pigment incorporated therein) and other resinous materials as well as glass, paper or metal. Paper supports can be acetylated or coated with polymer of an alpha-olefin containing 2 to 10 carbon atoms such as polyethylene, polypropylene or ethylene butene copolymers. The support may be any desired thickness, depending upon the desired end use of the element. In general, polymeric supports are usually from about 3 μm to about 200 μm in thickness and paper supports are generally from about 50 μm to about 1000 μm in thickness.

The dye-receiving layer to which the formed heat-transferable dye image is transferred according to the invention may be coated on the photographic element between the emulsion layer and support, or may be in a separate dye-receiving element which is brought into contact with the photographic element during the dye transfer step. If present in a separate receiving element, the dye receiving layer may be coated or laminated to a support such as those described for the photographic element support above, or may be self-supporting. In a preferred embodiment of the invention, the dye-receiving layer is present between the support and any silver halide emulsion layer of an integral photographic element.

The dye receiving layer may comprise any material effective at receiving the heat transferable dye image. Examples of suitable receiver materials include polycarbonates, polyurethanes, polyesters, polyvinyl chlorides, poly(styrene-co-acrylonitrile)s, poly(caprolactone)s and mixtures thereof. The dye receiving layer may be present in any amount which is effective for the intended purpose. In general, good results have-been obtained at a concentration of from about 1 to about 10 $g/m^2$ when coated on a support. In a preferred embodiment of the invention, the dye receiving layer comprises a polycarbonate. The term "polycarbonate" as used herein means a polyester of carbonic acid and a glycol or a dihydric phenol. Examples of such glycols or dihydric phenols are p-xylylene glycol, 2,2-bis(4-oxyphenyl)propane, bis(4-oxyphenyl)methane, 1,1-bis(4-oxyphenyl)ethane, 1,1 bis(oxyphenyl)butane, 1,1-bisphenol-A polycarbonate having a number average molecular weight of at least about 25,000 is used. Examples of preferred polycarbonates include General Electric LEXAN ® Polycarbonate Resin and Bayer AG MAC-ROLON ® 5700. Further, a thermal dye transfer overcoat polymer as described in U.S. Pat. No. 4,775,657 may also be used.

Heating times of from about 1.0 seconds to 30 minutes at temperatures of from about 50° to 200° C. (more preferably 75° to 160° C., and most preferably 80° to 120° C.) are preferably used to activate the thermal dye-transfer process.

While essentially any heat source which provides sufficient heat to effect transfer of the developed heat-transferable dye image from the emulsion layer to the dye receiving layer may be used, in a preferred embodiment dye transfer is effected by running the developed photographic element with the dye receiving layer (as an integral layer in the photographic element or as part of a separate dye receiving element) through a heated roller nip. Thermal activation transport speeds of 0.1 to 50 cm/sec are preferred to effect transfer at nip pressures of from about 500 Pa to 1,000 kPa and nip temperatures of from about 75° to 190° C.

In preferred embodiments of the aqueous developable elements of the present invention containing an integral receiver the amount of heat-transferable dye density transferred through drying is less than 20% of the total dye density transferable through drying and heating.

Another preferred method of imaging combines thermal or heat development of radiation sensitive silver halide, usually in the presence of an organic silver salt and an incorporated reducing agent, with thermally activated diffusion transfer of image dyes to a polymeric receiver. Such systems are described in U.S. Pat. Nos. 4,584,267, 4,590,154, 4,595,652, 4,770,981, 4,871,647, 4,948,698, 4,952,479, and 4,983,502, the disclosures of which are incorporated herein by reference. Such materials generally comprise a plurality of radiation sensitive layers. A typical radiation sensitive layer comprises radiation sensitive silver halide, an organic silver salt, a reducing agent, a dye forming or donating compound, a binder, and in preferred embodiments, one or more thermal solvents to facilitate the heat development of the silver halide and organic silver salt and the transfer of the resulting image dye to a suitable receiving element. In preferred multilayer materials, radiation sensitive layers sensitive to blue, green, and red light are included that produce yellow, magenta, and cyan heat-transferable image dyes for diffusion transfer, respectively. Thermal solvents and heat solvents of the type disclosed in the aforesaid U.S. Patent documents and disclosed herein by reference are included to facilitate heat development and thermal dye transfer. The preferred thermal solvents of the present invention serve to facilitate the thermal dye transfer of dyes through the binder to the receiver element.

The coupler compound to be used in this process of the invention may be any dye forming, dye providing, or dye donating material that will produce a heat transferable dye upon heat development. Preferred dye forming compounds are those that provide heat transferable cyan, magenta, or yellow dyes upon heat development.

The dye-providing materials of the present invention may be used either on their own or as admixtures. If desired, they may be used in combination with dye-providing materials of the type described in such patents as U.S. Pat. Nos. 4,631,251, 4,656,124, and 4,650,748.

The amount of the dye-providing materials used is not limited and may be determined according to their type, the manner in which they are used (i.e., either singly or in combination) or the number of photographic constituent layers of which the heat-processible photographic material of the present invention is composed (i.e., a single layer or two or more layers in superposition). As a guide, the dye-providing materials may be used in an amount of 0.005–50 g, preferably 0.1–10 g, per square meter. The dye-providing materials for use in the present invention may be incorporated in photographic constituent layers of the heat-processible photographic material by any suitable method.

The light-sensitive silver halide to be used in the present invention may include, for example, silver chloride, silver bromide, silver iodide, silver chlorobromide, silver chloroiodide and silver iodobromide. Such light-sensitive silver halides can be prepared by any of the methods commonly employed in the photographic art.

If desired, a silver halide emulsion having silver halide grains with a duplex structure (i.e., the halide composition of the grain surface differing from that of the interior) may be used and an example of such duplex grains is core/shell type silver halide grains. The shell of these grains may change in halide composition stepwise or gradually. The silver halide grains used may have a well-defined crystal habit as in cubes, spheres, octahedra, dodecahedra or tetradecahedra. Alternatively, they may not have any well-defined crystal shape. The silver halide grains in these light-sensitive emulsions may be coarse or fine; preferred grain sizes are on the order of 0.005 μm to 1.5 μm in diameter, with the range of from about 0.01 to about 0.5 μm being more preferred.

According to another method for preparing light-sensitive silver halides, a light-sensitive silver salt forming component may be used in the presence of organic silver salts (to be described below) so as to form light-sensitive silver halides in part of the organic silver salts.

These light-sensitive silver halides and light-sensitive silver salt forming component may be used in combination in a variety of methods, and the amount used in one photographic layer preferably ranges from 0.001 to 50 g, preferably 0.1–10 g, per square meter of base support.

The light-sensitive silver halide emulsions illustrated above may be chemically sensitized by any of the methods commonly employed in the photographic art. The light-sensitive silver halide emulsions to be used in the present invention may be spectrally sensitized with known spectral sensitizers in order to provide sensitivity to the blue, green, red, or near-infrared region.

Typical examples of the spectral sensitizers that can be used in the present invention include cyanine dyes, merocyanine dyes, complex (tri- or tetra-nuclear) cyanine dyes, holopolar cyanine dyes, styryl dyes, hemicyanine dyes and oxonol dyes. These sensitizers are incorporated in amounts ranging from $1\times10^{-4}$ to 1 mole, preferably from $1\times10^{-4}$ to $1\times10^{-1}$ mole, per mole of the light-sensitive silver halide or silver halide forming component. The sensitizers may be added at any stage of the preparation of silver halide emulsions; they may be added during the formation of silver halide grains, during the removal of soluble salts, before the start of chemical sensitization, during chemical sensitization or after completion of the chemical sensitization.

A variety of organic silver salts may optionally be employed in the heat-processible photographic material of the present invention in order to increase its sensitivity or improve its developability.

Illustrative organic silver salts that may be employed in the heat-processible photographic material of the present invention include: silver salts of long-chain aliphatic carboxylic acids and silver salts of carboxylic acids having a hetero ring, such as silver behenate and silver α-(1-phenyltetrazolethio)acetate (see U.S. Pat. Nos. 3,330,633, 3,794,496 and 4,105,451); and silver salts of an imino group as described in U.S. Pat. No. 4,123,274.

Among the organic silver salts listed above, silver salts of an imino group are preferred Particularly preferred are silver salts of benzotriazole derivatives such as 5-methylbenzotriazole or derivatives thereof, sulfobenzotriazole or derivatives thereof and N-alkylsulfamoylbenzotaiazole or derivatives thereof.

These organic silver salts may be used either singly or as admixtures in the present invention. Silver salts prepared in suitable binders may be immediately used without being isolated. Alternatively, isolated silver salts may be dispersed in binders by suitable means before they are used. The organic silver salts are preferably used in amounts ranging from 0.01 to 500 moles, more preferably from 0.1 to 100 moles, most preferably from 0.3 to 30 moles, per mole of the light-sensitive silver halide.

The reducing agent for use in the heat-processible photographic material of the present invention (the term "reducing agent" as used herein shall include precursors of the reducing agent) may be selected from among those which are commonly employed in the field of heat-processible photographic materials.

Reducing agents that can be used in the present invention include: p-phenylenediamine developing agents and their precursors or p-aminophenolic developing agents, phosphoroamidophenolic developing agents, suffonamidoaniline-based developing agents, hydrazone-based color developing agents, and precursors of these developing agents, such as those described in U.S. Pat. Nos. 3,531,286, 3,761,270, and 3,764,328. Also useful are phenols, sulfonamidophenols, polyhydroxybenzenes, naphthols, hydroxybinaphthyls, methylenebisnaphthols, methylenebisphenols, ascorbic acids, 3-pyrazolidones, pyrazolones, etc. The reducing agents may be used either on their own or as admixtures. The amount in which the reducing agents are used in the heat-processible photographic material of the present invention depend upon many factors such as the type of light-sensitive silver halide used, the type of organic acid silver salt, and the type of other additives used. Usually, the reducing agents are used in amounts ranging from 0.01 to 1,500 moles per mole of light-sensitive silver halide, with the range of 0.1–200 moles being preferred.

Illustrative binders that can be employed in the heat-processible photographic material of the present invention include: synthetic high-molecular weight compounds such as polyvinylbutyral, polyvinyl acetate, ethyl cellulose, polymethyl methacrylate, cellulose acetate butyrate, polyvinyl alcohol and polyvinylpyrrolidone; synthetic or natural high-molecular weight compounds such as gelatin, gelatin derivatives (e.g., phthalated gelatin), cellulose derivatives, proteins, starches, and gum arabic. These high-molecular weight compounds may be used either singly or in combination. It is particularly preferred to employ gelatin or its derivatives in combination with synthetic hydrophilic polymers such as polyvinylpyrrolidone and polyvinyl alcohol. A more preferred binder is a mixture of gelatin and polyvinylpyrrolidone.

The binders are generally used in amounts ranging from 0.05 to 50 g, preferably from 0.2 to 20 g, per square meter of the base support. The binders are preferably used in mounts of 0.1–10 g, more preferably 0.2–5 g, per gram of the dye-providing material.

The heat-processible photographic material of the present invention is produced by forming photographic constituent layers on a base support. A Variety of base supports can be used and they include: synthetic plastic films such as a polyethylene film, a cellulose acetate film, a polyethylene terephthalate film, and a polyvinyl chloride film; paper bases such as photographic raw paper, printing paper, baryta paper and resin-coated paper, and base prepared by coating these materials with electron-beam curable resin compositions, followed by curing of the same.

The heat-processible photographic material of the present invention is suitable for processing by transfer photography using an image-receiving member. In the practice of such a system, a variety of other thermal solvents have been utilized primarily as development facilitators in the heat-processible photographic material and/or the image-receiving member.

Particularly useful development-facilitating thermal solvents, for use in combination with the sugar surfactant thermal solvents of the invention, are urea derivatives (e.g., dimethylurea, diethylurea and phenylurea), amide derivatives (e.g., acetamide, benzamide and p-toluamide), sulfonamide derivatives (e.g., benzenesulfonamide and α-toluene-sulfonamide), and polyhydric alcohols (e.g., 1,6-hexanediol, 1,2-cyclohexanediol and pentaerythritol, and polyethylene glycol. Water-insoluble solid thermal solvents may be used with particular advantage.

Dye-transfer-facilitating thermal solvents, for use in combination with the sugar surfactant thermal solvents of the invention, described by Bailey, White and Texter in U.S. Ser. No. 07/804,868, Bailey, White and Texter in U.S. Ser. No. 08/073,821, Bailey and Mura in U.S. Ser. No. 08/073,822, Bailey and Mura in U.S. Ser. No. 08/073,825, and by Bailey, Mura and Eiff in U.S. Ser. No. 08/073,826 are particularly useful in the transfer of dyes from the image originating layer to a dye reciever layer.

Dye transfer facilitating sugar surfactant thermal solvents of this invention may be incorporated in various layers such as light-sensitive silver halide emulsion layers, intermediate layers, protective layers, and image-receiving layers in an image-receiving member so that the results desired in respective cases can be obtained. It is preferred that for employment in heat developable photographic elements that the dye-transfer-facilitating sugar surfactant thermal solvents of the present invention have melting points below 110° C.

The dye transfer facilitating sugar surfactant thermal solvents of this invention may be contained in the same layer as that containing the heat-transferable dye-forming compound or in layers not containing these dye-forming compounds. In elements of two or more layers the thermal solvents of our invention may be contained in any, some or all layers of the element. The dye transfer facilitating thermal solvents of our invention are preferably employed at a loading of between 10 and 300% by weight of the hydrophilic binder in each layer in the photographic element, or more preferably between 40 and 150% by weight of the hydrophilic binder in each layer. Further, the amount of dye transfer facilitating thermal solvent in the element is preferred to be between 10 and 200% by weight of the hydrophilic binder in the element, or more preferably between 10 and 120% by weight of the hydrophilic binder in the element. The thermal solvents of our invention are preferably employed at a level of between 100 to 3000 $mg/m^2$ for photographic elements having only a single color record, between 200 and 4500 $mg/m^2$ for photographic elements having only two color records and between 300 and 6000 $mg/m^2$ for photographic elements comprising three color records.

The organic silver salts and invention thermal solvents may be dispersed in the same liquid dispersion system. The binder, dispersion medium and dispersing apparatus used in this case may be the same as those employed in preparing the respective liquid dispersions.

Besides the components described above, the heat-processible photographic material of the present invention may incorporate various other additives such as development accelerators, antifoggants, base precursors, and other additives well known in the art.

Illustrative base precursors include compounds that undergo decarboxylation upon heating to release a basic substance (e.g., guanidium trichloroacetate) and compounds that are decomposed by reactions such as intramolecular nucleophilic substitution reaction to release amines. Other additives that are used as required in heat-processible photographic materials may also be incorporated in the heat-processible photographic material of the present invention. Illustrative additives include antihalation dyes, brighteners, hardeners, antistats, plasticizers, extenders, matting agents, surface-active agents and antifading agents. These additives may be incorporated not only into light-sensitive layers but also into non-light-sensitive layers such as intermediate layers, protective layers and backing layers.

The heat-processible photographic material of the present invention contains (a) a light-sensitive silver halide, (b) a reducing agent, (c) a binder and (d) the dye-providing material of the present invention. Preferably, it further contains (e) an organic silver salt as required. In a basic mode, these components may be incorporated in one heat-processible light-sensitive layer but it should be noted that they are not necessarily incorporated in a single photographic constituent layer but may be incorporated in two or more constituent layers in such a way that they are held mutually reactive. In one instance, a heat-processible light-sensitive layer is divided into two sub-layers and components (a), (b), (c) and (e) are incorporated in one sub-layer with the dye-providing material (d) being incorporated in the other sub-layer which is adjacent to the first sub-layer. The heat-processible light-sensitive layer may be divided into two or more layers including a highly sensitive layer and a less sensitive layer, or a high-density layer and a low-density layer.

The heat-processible photographic material of the present invention has one or more heat-processible light-sensitive layers on a base support. If it is to be used as a full-color light-sensitive material, the heat-processible photographic material of the invention generally has three heat-processible light-sensitive layers having different color sensitivities, each light-sensitive layer forming or releasing a dye of different color as a result of thermal development. A blue-sensitive layer is usually combined with a yellow dye, a green-sensitive layer with a magenta dye, and a red-sensitive layer with a cyan dye, but different combination may be used.

The choice of layer arrangements depends on the objective of a specific use. For instance, a base support is coated with a red-sensitive, a green-sensitive and a blue-sensitive layer, or in the reverse order (i.e., a blue-sensitive, a green-sensitive and a red-sensitive layer), or the support may be coated with a green-sensitive, a red-sensitive and a blue-sensitive layer.

Besides the heat-processible light-sensitive layers described above, the heat-processible photographic material of the present invention may incorporate non-light-sensitive layers such as a subbing layer, an intermediate layer, a protective layer, a filter layer, a backing layer and a release layer. The heat-processible light-sensitive layer and these and non-light-sensitive layers may be applied to a base support by coating techniques that are similar to those commonly employed to coat and prepare ordinary silver halide photographic materials.

The heat-processible photographic material of the present invention is developed after imagewise exposure and this can usually be done by merely heating the material at a temperature in the range of 80°–200° C., preferably 100°–170° C., for a period of from 1–180 seconds, preferably 1.5–120 seconds. A diffusible dye may be transferred onto an image-receiving layer simultaneously with thermal development by bringing the image-receiving layer in the image-receiving member into intimate contact with the light-sensitive surface of the photographic material. Alternatively, the photographic material brought into intimate contact with the image-receiving member after thermal development may be subsequently heated. The photographic material may be preliminarily heated in the temperature range of 70°–180° C. prior to exposure. In order to enhance the adhesion between the photographic material and the image-receiving member, they may be separately heated at a temperature of 80°–250° C. just prior to thermal development and transfer.

The heat-processible photographic material of the present invention permits the use of a variety of known heating techniques. All methods of heating that can be used with ordinary heat-processible photographic materials may be applied to the heat-processible photographic material of the present invention. In one instance, the photographic material may be brought into contact with a heated block or plate, or with heated rollers or a hot drum. Alternatively, the material may be passed through a hot atmosphere. High-frequency heating is also applicable. The heating pattern is in no way limited; preheating may be followed by another cycle of heating; heating may be performed for a short period at high temperatures or for a long period at low temperatures; the temperature may be elevated and lowered continuously; repeated cycles of heating may be employed; the heating may be discontinuous rather than continuous. A simple heating pattern is preferred. If desired, exposure and heating may proceed simultaneously.

Any image-receiving member may effectively be used in the present invention if the image-receiving layer employed has a capability for accepting the dye released or formed in the heat-processible light-sensitive layer as a result of thermal development. A preferred example is a polymer containing a tertiary amine or quaternary ammonium salt, as described in U.S. Pat. No. 3,709,690. Typical image-receiving layers suitable for use in diffusion transfer can be prepared by coating a base support, with a mixture in which a polymer containing an ammonium salt or tertiary amine is combined with gelatin or polyvinyl alcohol. Another useful dye-receiving layer may be formed of a heat-resistant organic high-molecular weight substance having a glass transition point of 40°–250° C. These polymers may be carried as image-receiving layers on a base support; alternatively, they may be used as bases on their own.

Synthetic polymers having glass transition points of 40° C. and above as described in "Polymer Handbook," 2nd ed., edited by J. Brandnap and E. H. Immergut, John Wiley & Sons are also useful. Useful molecular weights of these high-molecular weight substances arc generally in the range of 2,000–200,000. These high-molecular weight substances may be used either independently or as blends. Two or more monomers may be employed to make copolymers. Particularly preferred image-receiving layers comprise polyvinyl chloride and polycarbonate, and a plasticizer.

The polymers described above may be used as base supports that also serve as image-receiving layers to form image-receiving members. In this case, the base support may be formed of a single layer or two or more layers.

Base supports for image-receiving members may be transparent or non-transparent. Illustrative supports include: films of polymers such as polyethylene terephthalate, polycarbonate, polystyrene, polyvinyl chloride, polyethylene and polypropylene; base supports having pigments such as titanium oxide, barium sulfate, calcium carbonate and talc incorporated in these plastic films; baryta paper; resin-coated (RC) paper having paper laminated with pigment-loaded thermoplastic resins; fabrics; glass; metals such as aluminum; base supports prepared by coating these materials with pigment-loaded electron beam curable resin compositions, followed by curing of the latter; and base supports having pigment-loaded coating layers on these materials.

Particularly useful are the base support prepared by coating paper with a pigment-loaded electron-beam curable resin composition, followed by curing of the resin, and the base support prepared by applying a pigment coating layer to paper, which is then coated with an electron-beam curable resin composition, followed by curing of the resin. These base supports can immediately be used as image-receiving members since the resin layer itself serves as an image-receiving layer.

The heat-processible photographic material of the present invention may be of the integral type in which the light-sensitive layer and the image-receiving layer are formed on the same base support.

The heat-processible photographic material of the present invention is preferably provided with a protective layer. The protective layer may contain a variety of additives that are commonly employed in the photographic industry. Suitable additives include matting agents, colloidal silica, slip agents, organofluoro compounds (in particular, fluorine-based surface active agents), antistats, uv absorbers, high-boiling organic solvents, anti-oxidants, hydroquinone derivatives, polymer lattices, surface-active agents (including high-molecular surface-active agents), hardeners (including high-molecular hardeners), particulate organic silver salts, non-light-sensitive silver halide grains, antistats, development accelerators, etc.

A preferred embodiment of the present invention comprises a multilayer heatdevelopable color-photographic mated comprising a dye-diffusion-transfer element, activated by heat, said transfer element comprising contacting dye-receiver and dye-donor layers, where said receiver layers comprise a support, a polymeric layer comprising materials which have a high binding affinity for the yellow, magenta, and cyan dyes, and where said donor layers comprise a yellow dye producing layer, said layer comprising light-sensitive silver halide grains, an organic silver salt, a reducing agent, a yellow dye providing compound, and a hydrophilic binder, a magonta dye producing layer, said layer comprising light-sensitive silver halide grains, an organic silver salt, a reducing agent, a magenta dye providing compound, and a hydrophilic binder, a cyan dye producing layer, said layer comprising light-sensitive silver halide grains, an organic silver salt, a reducing agent, a cyan dye providing compound, and a hydrophilic binder, wherein said binder of said layers amount to from 3 to 10 g/m$^2$ of said coated material. These dyes are heat-transferable dyes. The dye-receiver and dye-donor layers may be coated together in a single, integral element. Alternatively, the dye-receiver and dye-donor layers may be coated in separate elements, said elements being laminated together prior to the thermal dye-diffusion transfer process. The preferred amount of sugar surfactant thermal solvent of this invention incorporated in a given layer is 0 to 300% by weight of the total amount of binder present in said layer. The amount of such thermal solvent incorporated in a given layer is 20 to 150% by weight of the total amount of binder present in said element. The advantages of the present invention will become more apparent by reading the following examples which are meant to be illustrative of the invention and not limiting in the materials described nor exhaustive in describing all the forms of practice.

EXAMPLES

The amphiphilic compounds tested in the following sets of examples are listed in Table II.

TABLE II

Test Amphiphilic Compounds.

| Compound Family | Trade Name | Average n* | Average m* | Average a | Average b | Manuf. HLB No. | Thermal Dye Transfer |
|---|---|---|---|---|---|---|---|
| SSTS-9 | APG-225 | 8.1 | 1.7 | — | — | 13.6 | Virtually None |
| SSTS-9 | APG-625 | 12.8 | 1.6 | — | — | 12.1 | Very Good |
| SSTS-9 | APG-600 | 12.8 | 1.4 | — | — | 11.6 | Very Good |
| | L-44 | — | — | 10 | 20 | ca. 15.0 | Virtually None |
| | TS-1 | — | — | | | | Excellent |
| | none | — | — | — | — | — | Virtually None |

*Compounds of structures SSTS-9 and SSTS-10 are usually composed of mixture of compounds with a spread in the integer values of m and n. Therefore, specific examples such as the most preferred compound cited above have fractional values for m and n.

$HO—(CH_2CH_2O)_a—(CH(CH_3)CH_2O)_b—(CH_2CH_2O)_a—H$

Pluronic L-44 where, a = 10; b = 20.

TS-1

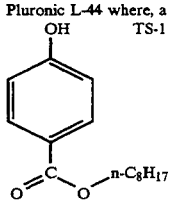

Example Set 1.

Melt Preparation: Gelatin/Thermal Solvent Interlayer

Figure 2:
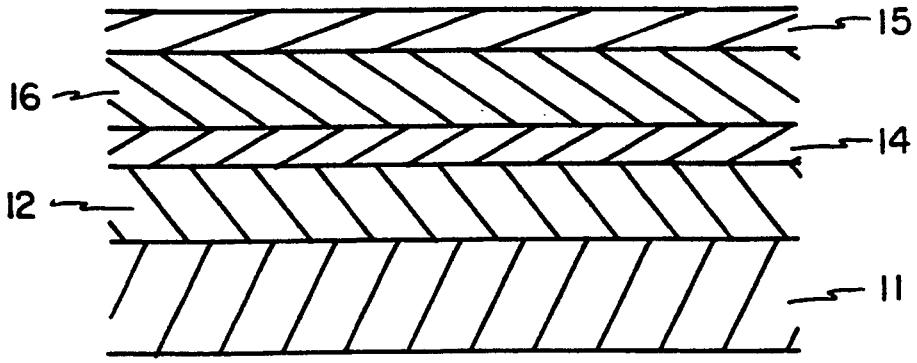
FIG. 2. Test coating format layer structure: 11—transparent or reflection base; 12—polymeric receiving layer, 14—interlayer containing gelatin and optionally thermal solvent; 15—protective overcoat layer; 16—diffusion transfer dye generation layer.

The compounds tested as dye-diffusion transfer thermal solvents are coated in a layer between the dye-receiver layer and the silver halide dye generation layer (FIG. 2). An interlayer consisting of only gelatin is prepared that serves as a comparison of the effect of added materials on the diffusion of heat-transferable dyes through gelatin layers. To 2.4 g of ethyl acetate is added, with stirring, a warm solution consisting of 28.8 g of melted and filtered 12.5% gelatin and 4.3 g of a 10% solution of surfactant surfactant-A (Alkanol XC TM, DuPont), 4.50 g of the test thermal solvent or surfactant (as a aqueous solution) in a total of 54.5 g of water. These mixtures are dispersed by three passes through a colloid mill set at a gap of 0.125 mm. To 60 g of these dispersion is added 1.5 g of 10% solution of surfactant-B (active Olin 10G TM), 63.7 g of distilled water and 4.8 g of melted and filtered 12.5% gelatin to prepare a coating melt.

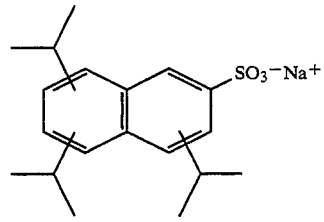

Surfactant-A

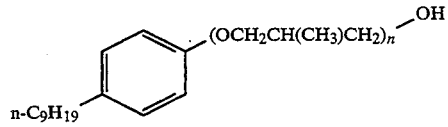

Surfactant-B

Melt Preparation: Coupler Dispersion

To a warmed mixture of 5.760 g of coupler M-1 and 17.5 g of ethyl acetate is added, with stirring, a warmed solution of 96.0 g of 12.5% gelatin in 170 g of distilled water and 12.0 g of an 10% solution of surfactant-A. This mixture is dispersed by three passes through a colloid mill with a gap of 0.125 mm. To 187.5 g of this dispersion is added 4.50 g of 10% solution of surfactant-B, 272 g of distilled water and 36.0 g of 12.5% gelatin.

Melt Preparation: Silver Halide Emulsion

To 41.4 g of a green sensitized AgCl cubic emulsion is added 26.3 g of 12.5% gelatin and 234 g of distilled water. The resulting melt has a silver content of 16.0 g of silver per kg of melt.

Melt Preparation: Protective Overcoat

To 1840 g of distilled water is added 384 g of melted 12.5% gelatin and 36 g of a 10% solution of surfactant surfactant-A. Within one minute of coating the protective overcoat 140 g of a 1.8% solution of the hardening agent 1,1-bis-(vinylsulfonyl)methane (HAR-1) is added.

Film Formation

The gelatin interlayer described above is coated on a corona discharge treated polymeric receiver layer paper base at an aim laydown of 1.60 g/m$^2$ for the gelatin. The reflection base material, resin coated with high density polyethylene, was coated with a mixture of polycarbonate, polycaprolactone and 1,4-didecyloxy-2,5-dimethoxy benzene at a 0.77:0.115:0.115 weight ratio respectively, at a total coverage of 3.28 g/m$^2$.

On the corona discard treated paper base comprising the polymeric dye receiver layer were coated the layers described above in order to prepare the color photographic materials described. The coated amounts of most of the components are given in units of grams per meter$^2$ (g/m$^2$), with the coated amounts of silver halide given in grams of silver per meter $^2$.

| | g/m$^2$ |
|---|---|
| First Layer: Thermal Solvent Test Layer | |
| Gelatin | 1.60 |
| Test Material | 1.60 |

-continued

| | g/m² |
|---|---|
| Second Layer: Dye Generation Layer | |
| Gelatin | 1.60 |
| Silver Chloride Emulsion (Cubic) Green Sensitized | 0.26 |
| Coupler M-1 | 0.39 |
| Third Layer: Protective Layer | |
| Gelatin | 1.08 |
| Hardener; 1,1-Bis(vinylsulfonyl)methane | 0.058 |

Photographic Processing

Several examples the coatings of example Set 1 are individually exposed on a Kodak 1-B sensitometer with a 0.01 sec 3000° K. white light exposure through an infrared filter and a 21 step 0 to 3.0 density step tablet. The coatings are developed for 45 sec at 35° C. in the developer formulation o given below containing either Kodak Color Developer 3 (CD-3) or Kodak Color Developer 2 (CD-2), followed by a bleach-fix (45 sec, to remove the silver and silver halide for investigation purposes only) followed by a 90 sec wash in distilled water. The films are dried at low temperatures (less than 40° C.). Status A reflection densitomeny of the integral images prior to heat activated dye transfer are obtained.

| Color Developer Solutions | | |
|---|---|---|
| Triethanolamine | | 12.41 g |
| Phorwhite REU (Mobay) | | 2.30 g |
| 30% aqueous Lithium polystyrene sulfonate | | 0.30 g |
| 85% aqueous N,N-diethylhydroxylamine | | 5.40 g |
| Lithium sulfate | | 2.70 g |
| Kodak Color Developing Agent CD-3 or CD-2 | | 0.01145 moles |
| 60% aqueous 1-Hydroxyethyl-1,1-diphosphonic acid | | 1.16 g |
| Potassium Carbonate, anhydrous | | 21.16 g |
| Potassium bicarbonate | | 2.79 g |
| Potassium chloride | | 1.60 g |
| Potassium bromide | | 20 mg |
| Water to make one liter at 27° C. | pH 10.04 ± 0.05 | — |

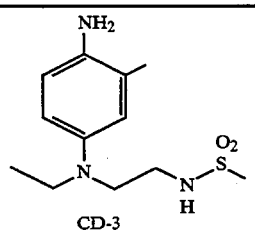

CD-3

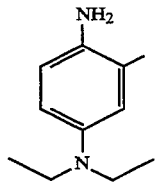

CD-2

| Bleach-Fix Solution | |
|---|---|
| Ammonium thiosulfate | 127.40 g |
| Sodium metabisulfite | 10.00 g |
| Glacial Acetic Acid | 10.20 g |
| Ammonium ferric EDTA | 110.40 g |
| Water to make one liter pH 5.50 ± 0.10 at 80° F. | — |

Heat Activated image Transfer

Dried integral films are laminated with gelatin subbed ESTAR TM film base and passed through a set of heated rollers at 0.635 cm/sec with roller surface temperatures of 110° C. and a pressure of 140 kPa. The two film bases are physically separated. The gelatin layers adhere to the gelatin subbed ESTAR TM base and are thus separated from the polymeric dye receiver layer and its support. Status A reflection densitometry is obtained on the polymeric dye-receiver layer coated on a reflective support. These density values determined with the appropriate Status A filter are given in Table III.

TABLE III

Green Density of Transferred Dye at a Step of Given Integral Density

| Expl No. | Type | Thermal Solvent | Transferred Density (CD3) 0 Pass | 1 Pass | 3 Pass | Transferred Density (CD2) 0 Pass | 1 Pass | 3 Pass |
|---|---|---|---|---|---|---|---|---|
| 1.1 | Comp | TS-1 | 0.46 | 1.37 | 1.85 | 0.56 | 2.17 | 2.44 |
| 1.2 | Comp | APG-225 | 0.09 | 0.11 | 0.11 | 0.11 | 0.13 | 0.11 |
| 1.3 | Invent | APG-625 | 0.07 | 0.44 | 0.73 | — | — | — |
| 1.4 | Invent | APG-600 | 0.08 | 0.58 | 1.10 | 0.11 | 1.30 | 1.72 |
| 1.5 | Comp | L-44 | 0.11 | 0.14 | 0.13 | 0.11 | 0.13 | 0.15 |
| 1.6 | Comp | none | 0.06 | 0.02 | 0.02 | 0.09 | 0.11 | 0.12 |
| Density | | Integral | 2.20 | — | — | 2.35 | — | — |

It is observed in Table III that both APG-600 and APG-625 produced significant dye transfer over the gelatin only comparison, APG-225 or Pluronic L-44. However, APG-600 is not as efficacious at promoting dye transfer under these conditions as is the control compound, TS-1. As shown in Table II the HLB number for both APG-600 and APG-625 is substantially lower than for the structurally analogous APG-225. Lower HLB values correspond to greater hydrophobicity or lower lipohilicity.

Example Set 2

The coatings of this set are prepared in a manner analogous to those described in Set 1 above. The structure of the coated materials and the coated amounts are the same as given in Set 1 with the exception of the dye-diffusion thermal solvents described in Table IV.

TABLE IV

Green Density of Transferred Dye at a Step with Integral Density of 2.0

| Expl No. | Type | Laydown (g/m²) APG-600 | TS-1 | Integral Density | Transferred Density (CD3) 0 Pass | 1 Pass | 3 Pass |
|---|---|---|---|---|---|---|---|
| 2.1 | Comp | — | 0.80 | 2.03 | 0.07 | 0.33 | 0.52 |
| 2.2 | Invent | 0.80 | 0.80 | 2.09 | 0.53 | 0.88 | 1.55 |
| 2.3 | Invent | 1.30 | — | 2.00 | 0.07 | 0.47 | 0.86 |

It is observed in Table IV that the prior art thermal solvent when coated at 0.80 g/m² produces a density transfer in 3 passes through the heated rollers of only 0.52 or about 24% of the original integral density of 2.03. The inclusion of an equivalent weight of the surfactant APG-600 results in a transfer of 75% of the integral dye density under similar transfer conditions.

The efficiency of density transfer with this combination is comparable to the 82% density transfer observed in Example 1.1 in Table III above. The combination of the prior art thermal solvent and the commercial surfactants of this invention result in a higher level of density transfer than either the reduced amounts of prior art thermal solvents or of high levels of these invention surfactants alone.

What is claimed is:

1. An aqueous-developable chromogenic photographic heat-transferable nonaqueous dye-diffusion-transfer photographic element comprising radiation sensitive silver halide, a dye-providing compound that forms or releases a heat-transferable image dye upon reaction of said compound with the oxidation product of a primary amine developing agent, a hydrophilic binder, and a thermal solvent for facilitating non-aqueous diffusion transfer wherein said thermal solvent comprises a sugar group containing amphiphilic compound, said amphiphilic compound comprising from one to three independently constituted 3 to 22 carbon atom hydrophobic tail(s) with one or more attached hydrophilic mono or oligosaccaridic rings or chains such that the HLB value of the compound is less than about 13.

2. The element of claim 1, wherein said element further comprises a dye-receiving layer.

3. The element of claim 1, wherein the total amount of said binder is from 0.2 to 20 g/m$^2$.

4. The element of claim 1, wherein the amount of thermal solvent incorporated in a given layer is 40 to 120% by weight of the total amount of hydrophilic binder in said layer.

5. The element of claim 1, wherein the amount of thermal solvent incorporated in a given layer is 10 to 120% by weight of the total amount of hydrophilic binder in said element.

6. The element of claim 1, wherein the amount of thermal solvent incorporated is 100 to 3000 mg/m$^2$ for photographic elements having only a single color record, is 200 to 4500 mg/m$^2$ for photographic elements having only two color records, or is 400 to 6000 mg/m$^2$ for photographic elements comprising three or more color records.

7. The element of claim 1, wherein said dye forming compound has a dye forming fragment having a formula weight of at least 90 and less than 600.

8. The element of claim 1, wherein said element further comprises a hydrogen bond donating/hydrogen bond accepting thermal solvent wherein said thermal solvent has the formula CI)

(I)

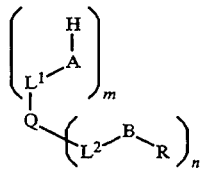

wherein

AH is a hydrogen bond donating group with an aqueous p$K_a$ value for proton loss of greater than 6;

$L^1$ and $L^2$ are each independently divalent linking groups consisting of groups of 1 to 12 atoms or are independently absent;

m is 1, 2, or 3;

Q comprises a group of 2 to 15 carbon atoms selected from the group consisting of aromatic rings, alkyl chains, alkyl rings, or ring-chain combinations, optionally substituted with substituents, Z, consisting of alkyl groups or halogens;

B is a hydrogen bond accepting group with an aqueous p$K_a$ value for proton gain of less than 6;

n is 1 or 2;

at least one of the groups AH and B cannot hydrogen bond to form a ring of either 5 or 6 atoms;

R is an alkyl, aryl or alkylaryl group of 1 to 18 carbon atoms;

the calculated log of the octanol/water partition coefficient (clogP) is greater than 3 and less than 10.

9. The element of claim 1, wherein said thermal solvent comprises a sugar group containing amphiphilic compound, said amphiphilic compound comprising one or more hydrophilic mono or oligosaccaridic rings comprising from one to three independently constituted 3 to 22 carbon atom hydrophobic rings or chains such that the HLB value for 1 the compound is less than about 13.

10. The element of claim 1, wherein said thermal solvent has the formula (II)

(II)

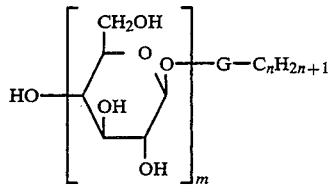

wherein n is 5 to 20;

m is 1 to 4;

G is absent, is a carbonyl (C═O) group or is an amido (C(═O)NR) group where R is H or an alkyl group of from 1 to 12 carbon atoms;

the HLB value of the compound is less than 13.0.

11. The element of claim 10, where in formula (II)

n is 6 to 18;

m is 1 to 4;

G is absent.

12. The element of claim 1, that contains a plurality of amphiphilic sugar group containing thermal solvents.

13. The element of claim 1, wherein said aqueous-developable chromogenic photographic heat-transferable non-aqueous dye-diffusion-transfer photographic element is a multilayer aqueous-developable color-photographic heat-transferable non-aqueous dye-diffusion-transfer photographic element further comprising a support;

a heat-transferable yellow dye producing layer containing a heat-transferable yellow dye providing compound, a radiation sensitive silver halide, and a hydrophilic binder;

a heat-transferable magenta dye producing layer containing a heat-transferable magenta dye providing compound, a radiation sensitive silver halide, and a hydrophilic binder;

a heat-transferable cyan dye producing layer containing a heat-transferable cyan dye providing compound, a radiation sensitive silver halide, and a hydrophilic binder.

14. A process for forming an improved dye image comprising the steps of:

providing in an aqueous-developable chromogenic photographic heat-transferable non-aqueous dye-diffusion-transfer photographic element comprising radiation sensitive silver halide, a heat-transferable dye-providing compound that forms or releases a heat-transferable image dye upon reaction of said compound with the oxidation product of a primary amine developing agent, a hydrophilic binder, and a thermal solvent for facilitating non-aqueous diffusion transfer wherein said thermal solvent comprises a sugar group containing amphiphilic compound, said amphiphilic compound comprising from one to three independently constituted 3 to 22 carbon atom hydrophobic tail(s) with one or more attached hydrophilic mono or oligosaccaridic rings or chains such that the HLB value of the compound is less than about 13;

exposing said non-aqueous dye-diffusion transfer element to actinic radiation;

contacting said element with an aqueous-developing solution, wherein said solution comprises a primary amine developing agent;

contacting said element with an aqueous bath of acidic pH;

drying said element;

providing a dye-receiving layer and a contiguous, dimensionally stable, support where said dye receiving layer is in physical contact with said dye-diffusion transfer element;

heating said dye-diffusion transfer element and dye-receiving layer to effect dye-diffusion transfer; and separating said dye-receiving layer and contiguous support from said dye transfer element.

15. The process of claim 14, wherein said element further comprises a dye-receiving layer.

16. The process of claim 14, wherein said dye forming compound has a dye forming fragment having a formula weight of at least 90 and less than 600.

17. The process of claim 14, wherein said thermal solvent has the formula (II)

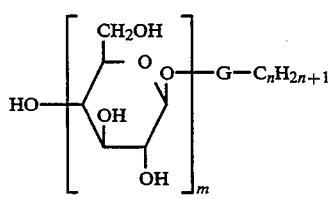

(II)

wherein n is 5 to 20;

m is 1 to 4;

G is absent is a carbonyl (C═O) group or is an amido (C(═O)R) group where R is H or an alkyl group of from 1 to 12 carbon atoms;

the HLB value of the compound is less than about 13.

18. The process of claim 14 for forming an improved multicolor dye image comprising the steps of:

providing aqueous-developable color-photographic heat-transferable nonaqueous dye-diffusion-transfer photographic element comprising a support;

a heat-transferable yellow dye producing layer containing a heat-transferable yellow dye providing compound, a radiation sensitive silver halide, and a hydrophilic binder;

a heat-transferable magenta dye producing layer containing a heat-transferable magenta dye providing compound, a radiation sensitive silver halide, and a hydrophilic binder;

a heat-transferable cyan dye producing layer containing a heat-transferable cyan dye providing compound, a radiation sensitive silver halide, and a hydrophilic binder.

19. A heat developable chromogenic photographic heat-transferable dye-diffusion transfer dement comprising radiation sensitive silver halide, a reducing agent, a dye-foraging compound wherein said compound forms a heat transferable image dye upon reaction of said compound with the oxidation product of said reducing agent, hydrophilic binder, and a thermal solvent wherein said thermal solvent comprises a sugar group containing amphiphilic compound, said amphiphilic compound comprising from one to three independently constituted 3 to 22 carbon atom hydrophobic tail(s) with one or more attached hydrophilic mono or oligosaccaridic rings or chains such that the HLB value of the compound is less than about 13.

20. The element of claim 19, wherein said reducing agent is a 4-(N,N-dialkylamino)phenyl sulfamic acid salt.

21. The element of claim 19, wherein said element further comprises a dye-receiving layer.

22. The element of claim 19, wherein the dye forming fragment of said dye forming compound has a formula weight of at least 110 and less than 400.

23. The element of claim 19, wherein said thermal solvent has the formula (II)

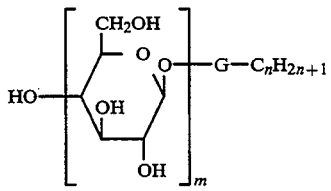

(II)

wherein n is 5 to 20;

m is 1 to 4;

G is absent, is a carbonyl (C═O) group or is an amido (C(═O)NR) group where R is H or an alkyl group of from 1 to 12 carbon atoms;

the HLB value of the compound is less than 13.0.

24. The element of claim 19, wherein said heat-developable chromogenic photographic heat-transferable non-aqueous dye-diffusion-transfer photographic element is a multilayer aqueous-developable color-photographic heat-transferable non-aqueous dye-diffusion-transfer photographic element comprising a support;

a heat-transferable yellow dye producing layer containing a heat-transferable yellow dye providing compound, a radiation sensitive silver halide, and a hydrophilic binder;

a heat-transferable magenta dye producing layer containing a heat-transferable magenta dye providing compound, a radiation sensitive silver halide, and a hydrophilic binder;

a heat-transferable cyan dye producing layer containing a heat-transferable cyan dye providing compound, a radiation sensitive silver halide, and a hydrophilic binder.

25. A process for forming an improved dye image in a photographic thermal dye-diffusion transfer element comprising the steps of:

providing a heat-developable chromogenic photographic non-aqueous dye-diffusion transfer element comprising;

radiation sensitive silver halide, a reducing agent, a heat-transferable dye-forming compound wherein said compound forms or releases a heat-transferable dye upon reaction of said compound with the oxidation product of a reducing agent, a hydrophilic binder, and a thermal solvent for facilitating non-aqueous dye diffusion transfer wherein said thermal solvent comprises a sugar group containing amphiphilic compound, said amphiphilic compound comprising from one to three independently constituted 3 to 22 carbon atom hydrophobic tail(s) with one or more attached hydrophilic mono or oligosaccaridic rings or chains such that the HLB value of the compound is less than about 13;

exposing said heat-developable element to actinic radiation heating said element to effect thermal development and dye-diffusion transfer, and separating said dye-receiving layer and contiguous support from said dye-diffusion transfer element by automated mechanical means.

26. The process of claim 25, wherein said element further comprises a dye-receiving layer.

27. The process of claim 25, wherein the dye forming fragment of said dye forming compound has a formula weight of at least 110 and less than 400.

28. The process of claim 25, wherein said thermal solvent has the formula (II)

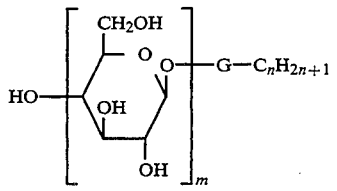

(II)

wherein n is 5 to 20;

m is 1 to 4;

G is absent, is a carbonyl (C═O) group or is an amido (C(═O)NR) group where R is H or an alkyl group of from 1 to 12 carbon atoms;

the HLB value of the compound is less than 13.0.

29. The process of claim 25 for forming an improved multicolor dye image comprising the steps of:

providing aqueous-developable color-photographic heat-transferable non-aqueous dye-diffusion-transfer safe photographic element comprising a support;

a heat-transferable yellow dye producing layer containing a heat-transferable yellow dye providing compound, a radiation sensitive silver halide, and a hydrophilic binder;

a heat-transferable magenta dye producing layer containing a heat-transferable magenta dye providing compound, a radiation sensitive silver halide, and a hydrophilic binder;

a heat-transferable cyan dye producing layer containing a heat-transferable cyan dye providing compound, a radiation sensitive silver halide, and a hydrophilic binder.

* * * * *